US011473283B2

(12) United States Patent
Tone et al.

(10) Patent No.: US 11,473,283 B2
(45) Date of Patent: Oct. 18, 2022

(54) FLUSH TOILET

(71) Applicant: TOTO LTD., Kitakyushu (JP)

(72) Inventors: Yusuke Tone, Kitakyushu (JP); Shu Kashirajima, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/411,436

(22) Filed: Aug. 25, 2021

(65) Prior Publication Data

US 2022/0064926 A1 Mar. 3, 2022

(30) Foreign Application Priority Data

Aug. 28, 2020 (JP) ..... JP2020-144897

(51) Int. Cl.
*E03D 5/01* (2006.01)
*E03D 1/26* (2006.01)
*E03D 11/02* (2006.01)

(52) U.S. Cl.
CPC ..... *E03D 5/01* (2013.01); *E03D 1/26* (2013.01); *E03D 11/02* (2013.01); *E03D 2201/30* (2013.01)

(58) Field of Classification Search
CPC ..... E03D 5/01; E03D 11/02; E03D 1/26
USPC ..... 4/431
See application file for complete search history.

(56) References Cited

U.S. PATENT DOCUMENTS

2009/0313750 A1 12/2009 Okubo et al.

FOREIGN PATENT DOCUMENTS

JP 2009-30405 A 2/2009
JP 2020-51236 A 4/2020

*Primary Examiner* — Christine J Skubinna
(74) *Attorney, Agent, or Firm* — BakerHostetler

(57) ABSTRACT

A flush toilet includes a toilet main body and a tank device. The tank device includes a water supply unit a storage tank, a pump, and a suction pipe. The water supply unit is configured to supply the flush water the storage tank while the pump is being driven. The storage tank includes a large tank section that includes a lowest bottom surface of the storage tank and that is a large-capacity side, and a small tank section that is a small-capacity side. The storage tank main body includes a water supply port on an upper surface of the storage tank. The water supply unit is configured to supply the flush water to the storage tank through the water supply port. The water supply port of the storage tank and an upstream-end opening of the suction pipe are both provided on a large tank section side.

4 Claims, 7 Drawing Sheets

FLUSH TOILET

CROSS REFERENCE TO RELATED APPLICATION

This application claims benefit of priority to Japanese Patent Application No. 2020-144897, filed on Aug. 28, 2020, the entire content of which is incorporated herein by reference.

FIELD OF THE INVENTION

The present invention relates to a flush toilet, and more particularly, to a flush toilet for discharging waste with flush water.

BACKGROUND OF THE INVENTION

Conventionally, as flush toilets for discharging waste with flush water, those that flush a toilet main body by discharging flush water stored in a storage tank main body into the toilet main body by a pump device are known, as described in Patent Document 1 (Japanese Patent Laid-Open No. 2009-30405), for example.

With such conventional flush toilets, tap water (flush water) supplied from a water pipe is discharged using a water supply pressure from a rim spout port formed in a rim of the toilet main body, and also, flush water stored in the storage tank main body is pressurized by the pump device to be discharged from a jet spout port formed in a bottom portion of a bowl.

Furthermore, the conventional flush toilet described in Patent Document 1 mentioned above performs so-called "follow-up water supply" of supplying water into a tank while the pump device is being operated. Accordingly, toilet flushing can be performed with flush water at a great flow rate even when size of the storage tank main body is reduced.

These days, for improvement of the design, there is a demand for storage tank main bodies that are compatible with flush toilets of various designs, and when shape of the storage tank main body becomes complex, a height difference (a step) is formed on a bottom surface of the storage tank main body. Furthermore, an opening of a suction pipe of the pump device is formed to be positioned in the bottom surface of the storage tank main body, and there is a problem that, due to the height difference in the bottom surface of the storage tank main body, it takes time for flush water to flow into the suction pipe and toilet flushing is thus possibly interrupted in the middle.

The present invention has been made to solve the problem of the conventional art as described above, and is aimed at providing a flush toilet that allows size of a storage tank main body to be reduced, and that is able to supply a sufficient amount of flush water to a toilet main body.

SUMMARY OF THE INVENTION

To solve the problem as described above, the present invention is a flush toilet for discharging waste with flush water, the flush toilet comprising: a toilet main body including a bowl configured to receive waste, a rim formed at a top edge of the bowl, and a discharge trap configured to discharge the waste in the bowl; and a tank device configured to supply the flush water to the toilet main body, the tank device being provided behind the toilet main body, wherein the tank device includes a storage tank main body provided behind the toilet main body and above a floor surface, a water supply unit configured to supply the flush water supplied from a water supply source to the storage tank main body, a pump provided on a downstream side of the storage tank main body, the pump being configured to feed the flush water from the storage tank main body to the toilet main body under pressure, and a suction pipe including an upstream-end opening provided in the storage tank main body, the suction pipe being configured to allow suction of the flush water in the storage tank main body from the upstream-end opening to a pump side by operation of a drive unit of the pump, wherein the water supply unit is configured to supply water to the storage tank main body while the pump is being driven, the storage tank main body includes a large tank section on a large-capacity side and a small tank section on a small-capacity side, the large tank section including a lowest bottom surface of the storage tank main body, and the storage tank main body includes a water supply port on an upper surface of the storage tank main body, the water supply unit being configured to supply the flush water to the storage tank main body through the water supply port, and the water supply port of the storage tank main body and the upstream-end opening of the suction pipe are both provided on a large tank section side. According to the present invention configured in the above manner, due to the drive unit of the pump being driven while water is being supplied from the water supply unit to the storage tank main body, flush water may be fed, under pressure, from the storage tank main body to the toilet main body. At this time, because so-called "follow-up water supply" of performing water supply to the storage tank main body and supply of flush water from the pump to the toilet main body at the same time can performed, the amount of stored water in the storage tank main body may be reduced, and the size of the storage tank main body may be reduced. Furthermore, the water supply port of the storage tank main body and the upstream-end opening of the suction pipe are both provided on the large tank section side where the lowest bottom surface of the storage tank main body is included, and thus, when the flush water from the water supply unit is supplied to the storage tank main body through the water supply port of the storage tank main body, the flush water may be supplied first to the large tank section side with a larger capacity than the small tank section. Accordingly, supply of water to the suction pipe provided on the large tank section side does not run out, and even in a case where the follow-up water supply is performed for the storage tank main body having a complex tank shape due to the small tank section and the large tank section, toilet flushing may be prevented from being interrupted. As a result, the size of the storage tank main body can be reduced, and also, a sufficient amount of flush water can be supplied from the tank device to the toilet main body.

In the present invention, preferably, the storage tank main body has a shape that is asymmetrical in a left-right direction due to the large tank section and the small tank section, the large tank section being provided on a large-capacity side of the storage tank main body that is divided into two at a center in the left-right direction, the small tank section being provided on a small-capacity side of the storage tank main body that is divided into two at the center in the left-right direction, and the water supply port of the storage tank main body is provided in an upper surface of the large tank section, and the suction pipe is provided in the large tank section. According to the present invention configured in the above manner, the water supply port of the storage tank main body is provided in the upper surface of the large tank section of the storage tank main body, and also, the suction pipe is provided in the large tank section of the storage tank main body, and thus, both the water supply port of the storage tank main body and the suction pipe may be collectively provided at the large tank section of the storage tank main body. Accordingly, a limited space behind the toilet main body may be effectively used, and tank capacity of the storage tank main body may be increased. Furthermore, by providing the water supply port of the storage tank main body and the suction pipe on the large tank section side of the storage tank main body, flush water may be supplied first to the large tank section with a larger capacity than the small tank section, and thus, supply of water to the suction pipe may be prevented from running out. Accordingly, the follow-up water supply may be continuously performed.

In the present invention, preferably, the storage tank main body includes a collision area where the flush water supplied from the water supply unit into the storage tank main body collides, and the collision area is configured to allow at least a part of the flush water to flow toward the upstream-end opening of the suction pipe after collision. According to the present invention configured in the above manner, the collision area provided in the storage tank main body may cause at least a part of flush water colliding into the collision area to flow toward the upstream-end opening of the suction pipe, and thus, the flush water may be efficiently guided toward the suction pipe. Accordingly, even when positions of the water supply port and the suction pipe at the storage tank main body are shifted from each other, flush water that is supplied to the storage tank main body from the water supply port of the storage tank main body may be supplied preferentially to the upstream-end opening of the suction pipe. Accordingly, supply of water to the suction pipe is prevented from running out, and the follow-up water supply may be continuously performed.

In the present invention, preferably, the suction pipe further includes a downstream-end opening that is provided on the pump side, a transverse pipe part that horizontally extends in a left-right direction from the downstream-end opening, and a vertical pipe part that extends from one end side of the transverse pipe part to the upstream-end opening, where the collision area is provided on a circumferential surface, of the transverse pipe part, disposed below the water supply port, and an outer circumferential surface of the vertical pipe part is formed to extend obliquely downward, in a side view, toward the upstream-end opening from a connection portion to the transverse pipe part. According to the present invention configured in the above manner, even when positions of the water supply port and the suction pipe (the vertical pipe part and the transverse pipe part) at the storage tank main body are shifted from each other, flush water that is supplied to the storage tank main body from the water supply port of the storage tank main body may be made to collide into the collision area provided below the water supply port, on the circumferential surface of the transverse pipe part of the suction pipe in the storage tank main body. Then, at least a part of the flush water colliding into the collision area can easily flow to the upstream-end opening of the vertical pipe part of the suction pipe thanks to the outer circumferential surface, of the vertical pipe part of the suction pipe, extending obliquely downward toward the upstream-end opening, and thus, the flush water supplied to the storage tank main body may be efficiently and preferentially guided to the suction pipe side. Accordingly, supply of water to the suction pipe is prevented from running out, and the follow-up water supply may be continuously performed. Furthermore, because the outer circumferential surface of the vertical pipe part of the suction pipe is formed to extend obliquely downward, in the side view, toward the upstream-end opening from the connection portion to the transverse pipe part, a height dimension of the vertical pipe part of the suction pipe in an up-down direction may be kept small. Accordingly, a housing space for the storage tank main body in the up-down direction may be made small on the large tank section side where the suction pipe is provided.

With the flush toilet of the present invention, size of the storage tank main body may be reduced, and also, a sufficient amount of flush water may be supplied to a toilet main body.

DETAILED DESCRIPTION OF THE PREFERRED EMBODIMENTS

Figure 1:
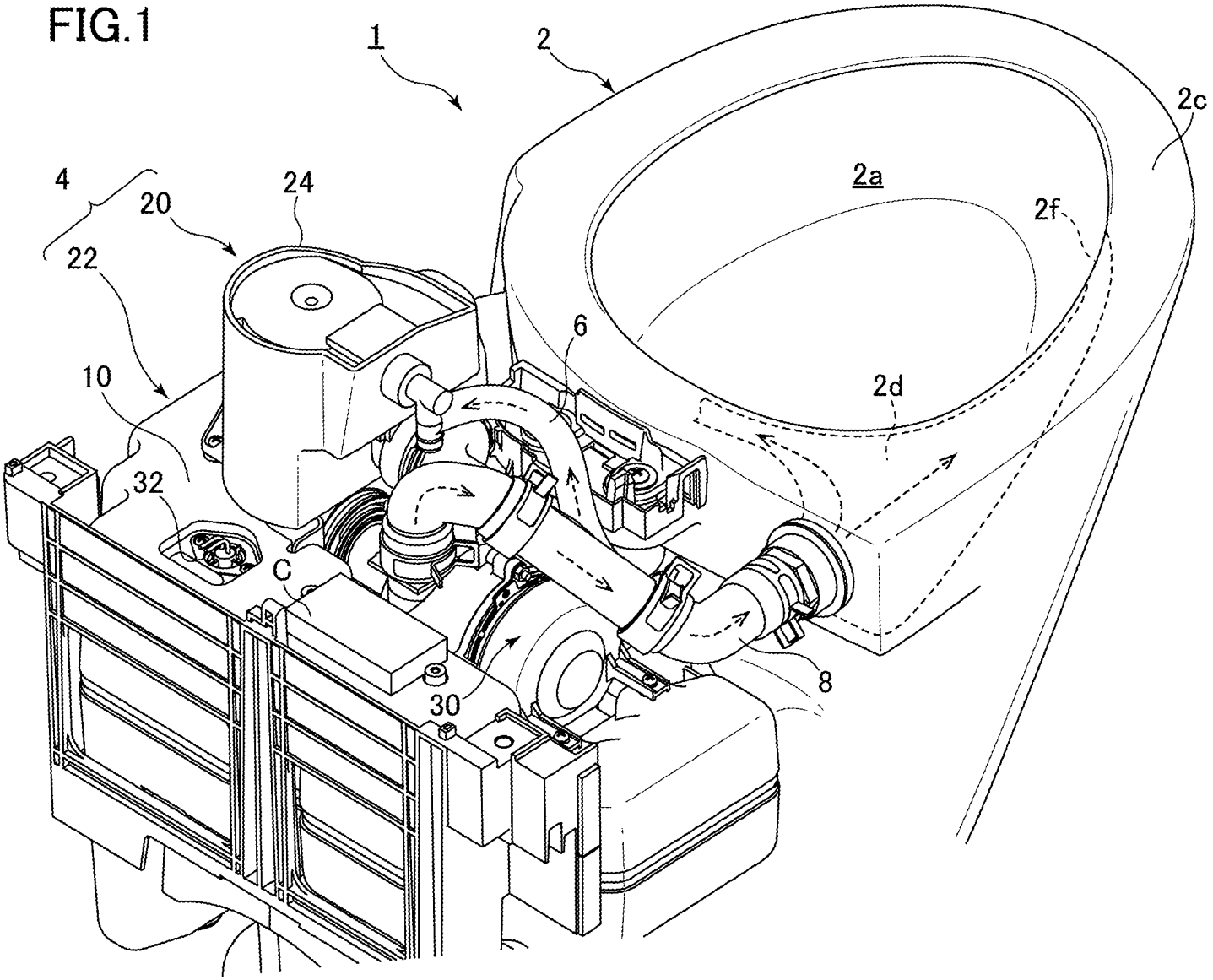
FIG. 1 is a schematic perspective view showing a flush toilet according to one embodiment of the present invention, where the flush toilet is seen obliquely from behind and above.
Figure 2:
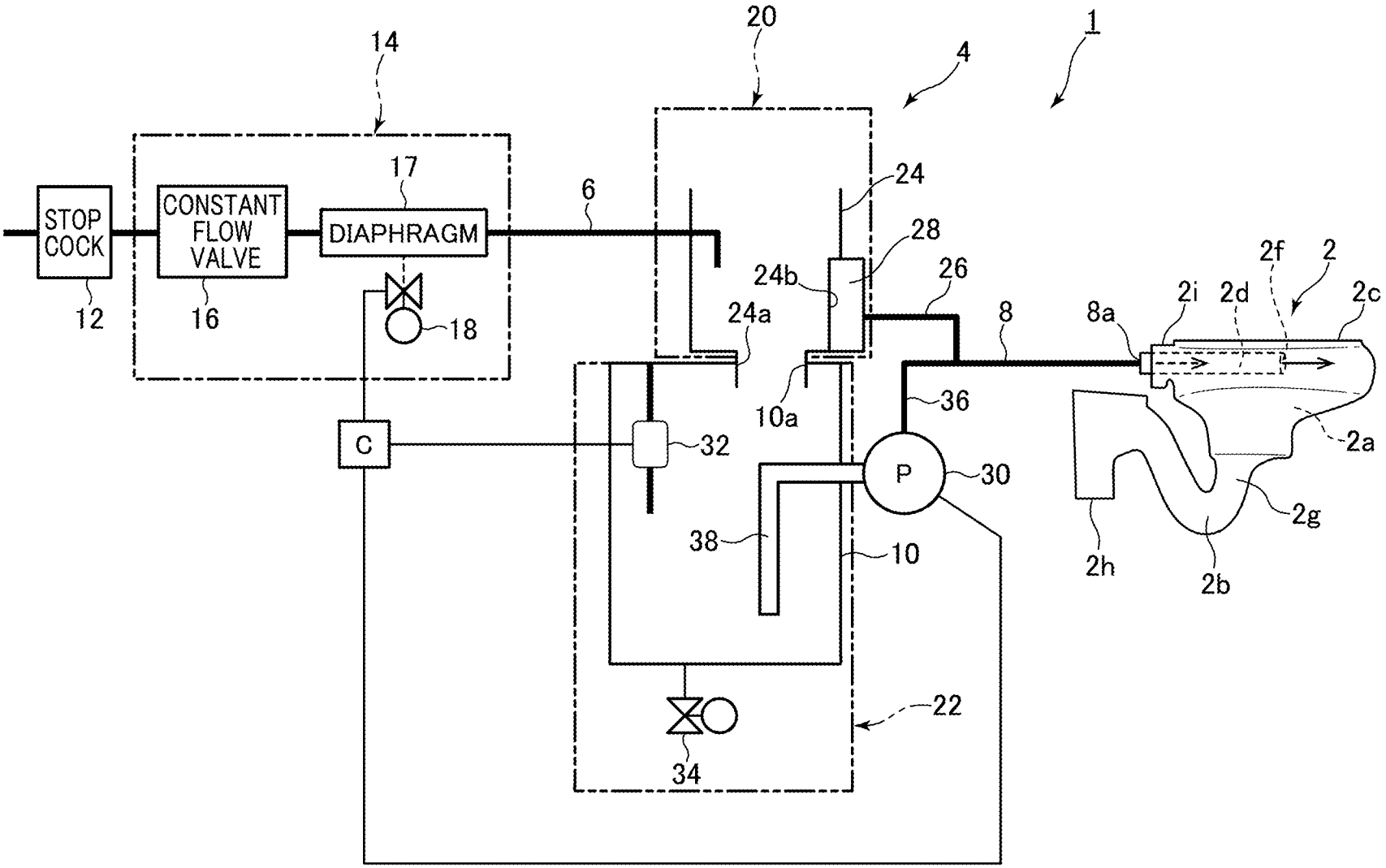
FIG. 2 is an overall configuration diagram of the flush toilet according to the embodiment of the present invention.

Hereinafter, a flush toilet according to one embodiment of the present invention will be described with reference to the appended drawings. First, FIG. 1 is a schematic perspective view showing the flush toilet according to the embodiment of the present invention, where the flush toilet is seen obliquely from behind and above. Furthermore, FIG. 2 is an overall configuration diagram of the flush toilet according to the embodiment of the present invention. As shown in FIGS. 1 and 2, a flush toilet 1 according to the embodiment of the present invention includes a toilet main body 2 made of ceramics, and a tank device 4 that is provided behind the toilet main body 2. Furthermore, the toilet main body 2 includes a bowl 2*a* for receiving waste, a discharge trap (a discharge trap pipe 2*b*) for discharging waste in the bowl 2*a*, the discharge trap extending from a bottom portion of the bowl 2*a*, and a rim 2*c* formed at a top edge of the bowl 2*a*.

Next, as shown in FIGS. 1 and 2, the tank device 4 includes a water supply pipe 6 (a water supply unit) and a water discharge pipe 8 that are connected, respectively, on an upstream side and a downstream side of the tank device 4. An upstream side of the water supply pipe 6 is connected to an external water supply source (not shown) such as a water system. A downstream side of the water supply pipe 6 is connected to a storage tank 10 (of which more later) of the tank device 4. Flush water is thus supplied from the water supply pipe 6 to the storage tank 10. Furthermore, a stop cock 12 and a valve unit 14 are provided on the water supply pipe 6, from the upstream side to the downstream side. Moreover, the valve unit 14 includes a fixed flow valve 16 provided on the water supply pipe 6, and an electromagnetic valve 18 for opening/closing an on-off valve (a diaphragm valve 17) provided downstream of the fixed flow valve 16.

Next, as shown in FIGS. 1 and 2, the tank device 4 further includes a connecting unit 20 that is connected downstream of the valve unit 14 of the water supply pipe 6, and a tank unit 22 connected on a downstream side of the connecting unit 20 and including the storage tank 10. At the valve unit 14, a flow rate of flush water in the water supply pipe 6 is adjusted to be constant by the fixed flow valve 16. Then, when the electromagnetic valve 18 is electromagnetically opened, and a flow path in the water supply pipe 6 is released by the on-off valve (the diaphragm valve 17), the flush water in the water supply pipe 6 is supplied to the tank unit 22 through the connecting unit 20. That is, the valve unit 14 as a whole functions, together with the water supply pipe 6, as a water supply unit for supplying, to the storage tank 10, flush water that is supplied from a water supply source such as a water system.

As shown in FIG. 2, the connecting unit 20 includes a water receiving housing 24 (a small tank), an overflow pipe 26, and a check valve 28. Moreover, a lower opening 24*a* of the water receiving housing 24 is detachably connected to an upper opening 10*a* of the storage tank 10 of the tank unit 22. Additionally, details of the water receiving housing 24 and peripheral parts thereof will be given later.

The overflow pipe 26 connects an overflow port 24*b* provided in a part of a side wall of the water receiving housing 24 and the water discharge pipe 8. An upstream side of the water discharge pipe 8 is a connecting pipe (a flush water supply pipe) connected to a pump 30 of the tank device 4, and a downstream side of the water discharge pipe 8 is connected to a rim conduit 2*d* inside the rim 2*c* of the toilet main body 2. Moreover, the check valve 28 is provided at the overflow port 24*b*, and is capable of allowing flush water in the water receiving housing 24 to flow into the overflow pipe 26 from the overflow port 24*b* while preventing flush water in the overflow pipe 26 from flowing backward into the water receiving housing 24.

As shown in FIG. 2, the tank unit 22 includes the storage tank 10, a pump 30, a float switch 32, a drain plug 34, a controller C, and the like. The pump 30 is provided at a part of (midway along) a water passage pipe 36 that is connected to the upstream side of the water discharge pipe 8. An upstream end 36*a* of the water passage pipe 36 is connected to a downstream end 38*a* of a suction pipe 38 provided in the storage tank 10. Additionally, details of the water passage pipe 36 and the suction pipe 38 will be given later.

Flush water stored in the storage tank 10 is suctioned into the suction pipe 38 from a suction port 38*b* that is an upstream-end opening of the suction pipe 38 by operation of the pump 30, and is then suctioned into the water passage pipe 36 from the suction pipe 38 and fed, under pressure, to the water discharge pipe 8 through the pump 30. All the flush water that is supplied from the storage tank 10 to the water discharge pipe 8 by the pump 30 is thus supplied into the rim conduit 2*d* from an inlet 2*e* of the rim conduit 2*d*. Then, the flush water in the rim conduit 2*d* is discharged into the bowl 2*a* from a rim spouting port 2*f* on a downstream end of the rim conduit 2*d*, and toilet flushing (toilet flushing by so-called 100% rim spouting) is thus performed. That is, the water passage pipe 36 and the water discharge pipe 8 each function as a flush water supply pipe for supplying, to the toilet main body 2, flush water that is fed, under pressure, from the storage tank 10 by the pump 30.

The float switch 32 detects a water level in the storage tank 10. An opening/closing operation of the electromagnetic valve 18 of the valve unit 14 is controlled by the controller C based on the water level in the storage tank 10 that is detected by the float switch 32. Furthermore, the operation of the pump 30 is also controlled by the controller C based on the water level in the storage tank 10 that is detected by the float switch 32. For example, in the case where the water level in the storage tank 10 that is detected by the float switch 32 is at or below a predetermined water level, the electromagnetic valve 18 is opened, the water supply pipe 6 is released, and the pump 30 is caused to operate. Then, when the water level in the storage tank 10 reaches the predetermined water level, the electromagnetic valve 18 is closed, the water supply pipe 6 is closed, and the pump 30 is stopped. Furthermore, due to control by the controller C, the pump 30 may be driven while water is being supplied from the water supply pipe 6 to the storage tank 10, and flush water may be fed, under pressure, from the storage tank 10 to the toilet main body 2, and water supply from the water supply pipe 6 to the storage tank 10 and supply of flush water to the toilet main body 2 by the pump 30 may be performed at the same time.

The drain plug 34 is provided in a bottom surface of the storage tank 10. In normal use, the drain plug 34 is closed at all times, and the drain plug 34 can be removed as necessary to discharge the flush water in the storage tank 10 to outside.

Figure 3:
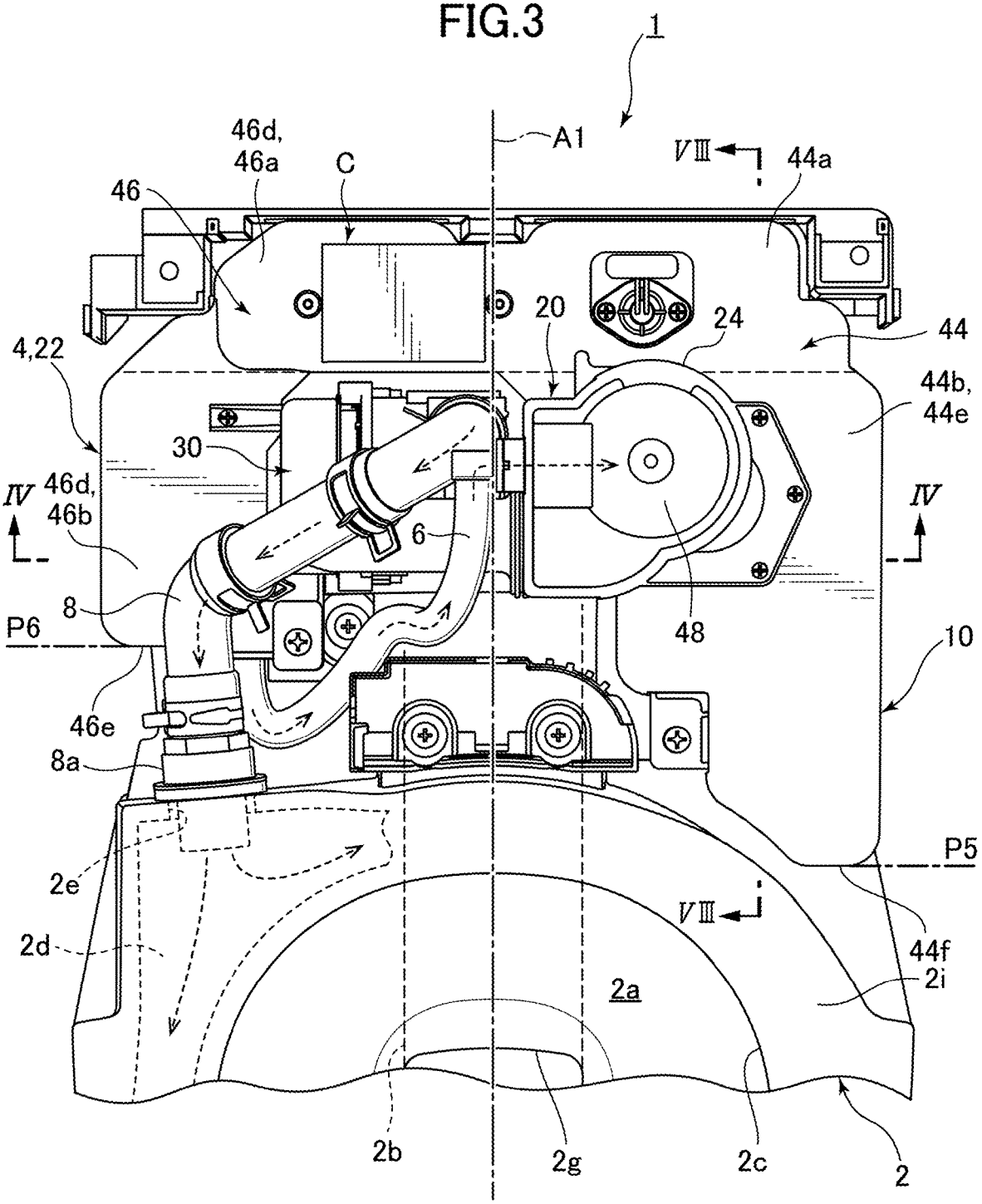
FIG. 3 is an enlarged partial plan view showing a part of the flush toilet according to the embodiment of the present invention in an enlarged manner, the part corresponding to a tank unit.
Figure 4:
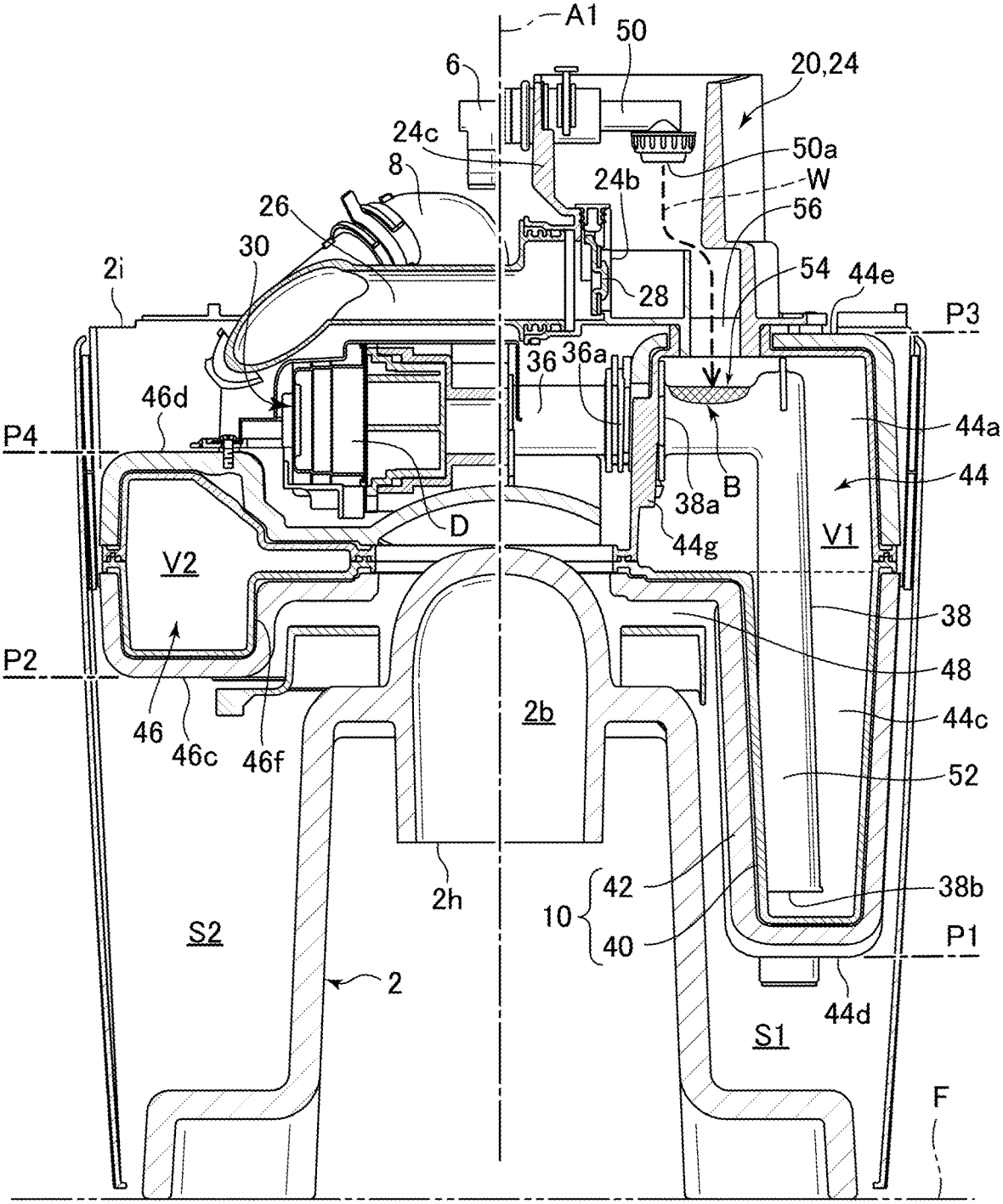
FIG. 4 is a cross-sectional view taken along a line IV-IV in FIG. 3.
Figure 5:
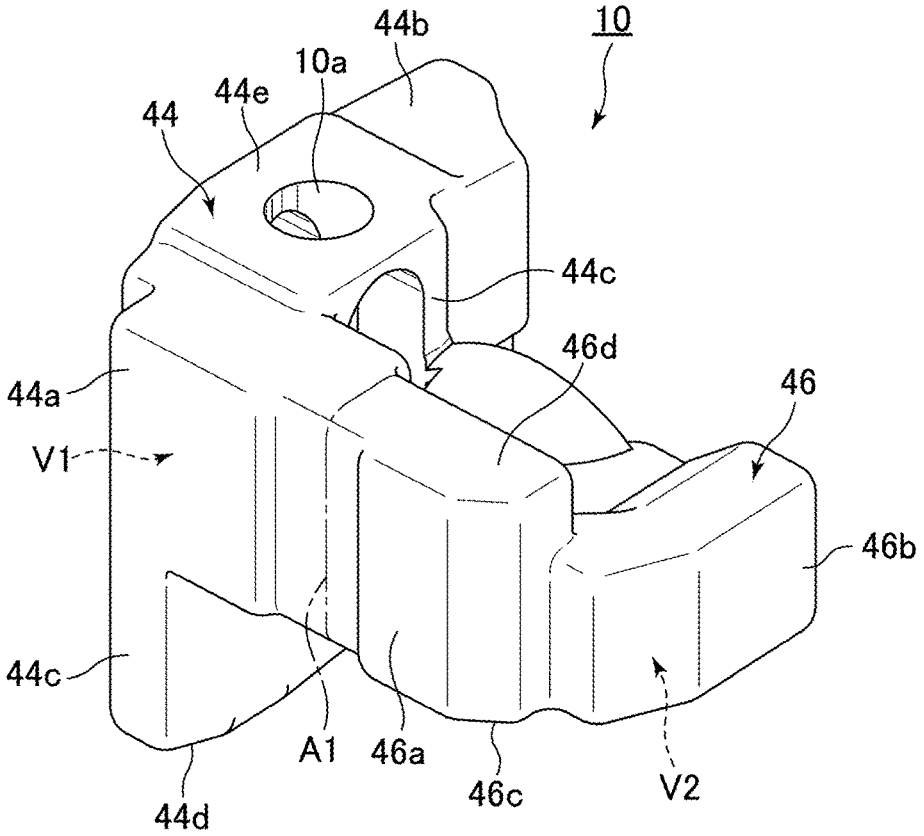
FIG. 5 is a perspective view showing a storage tank of the flush toilet according to the embodiment of the present invention, where the storage tank is seen obliquely from behind and above.
Figure 6:
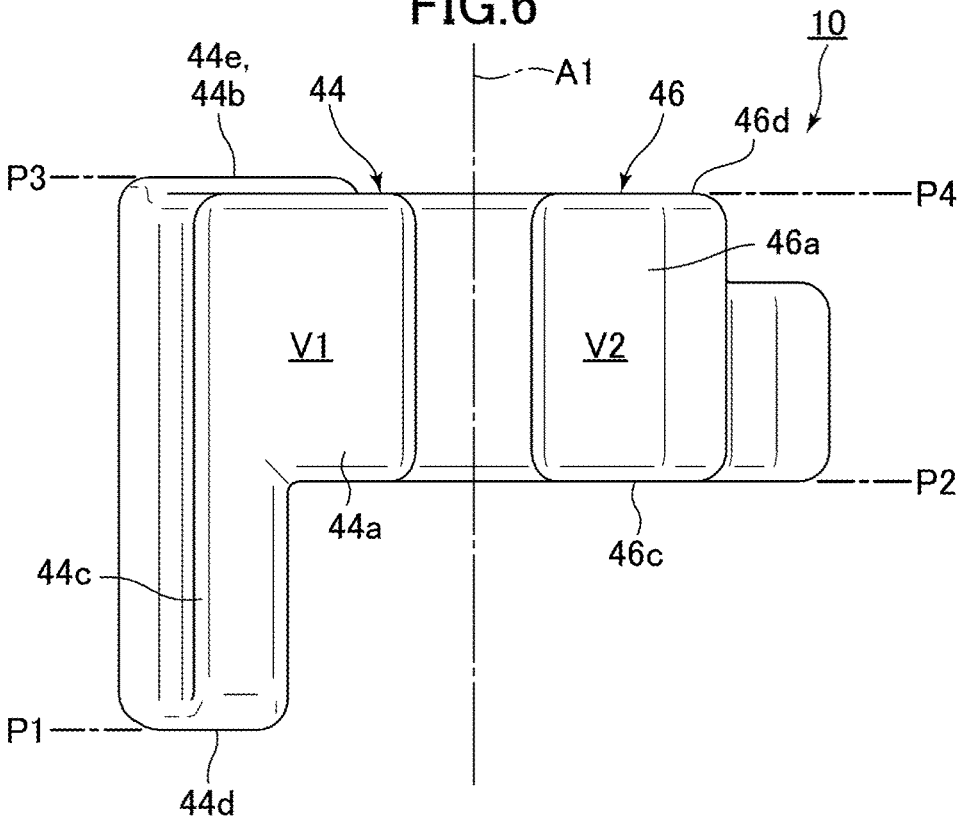
FIG. 6 is a rear view of the storage tank of the flush toilet according to the embodiment of the present invention.

Next, details of the storage tank 10 of the tank unit 22 will be given with reference to FIGS. 3 to 6. FIG. 3 is an enlarged partial plan view showing a part of the flush toilet according to the embodiment of the present invention in an enlarged manner, the part corresponding to the tank unit. FIG. 4 is a cross-sectional front view taken along a line IV-IV in FIG. 3. First, as shown in FIGS. 3 and 4, the storage tank 10 of the tank unit 22 includes a single tank main body 40, and an antisweat material 42 covering an outside of the tank main body 40. Next, FIG. 5 is a perspective view showing the storage tank of the flush toilet according to the embodiment of the present invention, where the storage tank is seen obliquely from behind and above. Furthermore, FIG. 6 is a rear view of the storage tank of the flush toilet according to the embodiment of the present invention. As shown in FIGS. 3 to 6, when a virtual vertical plane that divides the storage tank 10 of the tank unit 22 into two at a center in a left-right direction is taken as "vertical plane A1", the single tank main body 40 of the storage tank 10 and the antisweat material 42 on the outside include a large tank section 44 and a small tank section 46 on left and right of the vertical plane A1, and are divided into two in the left-right direction by the vertical plane A1, into the large tank section 44 and the small tank section 46. That is, as shown in FIG. 6, when the tank main body 40 and the antisweat material 42 are seen from a rear surface side, the large tank section 44 is disposed on a left side of the vertical plane A1, and when the tank main body 40 and the antisweat material 42 are seen from the rear surface side, the small tank section 46 are disposed on a right side of the vertical plane A1, and a capacity V1 of the large tank section 44 is set greater than a capacity V2 of the small tank section 46 (V1>V2). Accordingly, because of the large tank section 44 and the small tank section 46, the storage tank 10 has an asymmetrical shape in the left-right direction (a deformed shape of an approximately C-shape or U-shape in a plan view).

Furthermore, as shown in FIGS. 1, 3 and 4, the discharge trap pipe 2*b* of the toilet main body 2 extends in the front-back direction from an inlet 2*g* that is connected to a lower part of the bowl 2*a* to an outlet 2*h* behind the bowl 2*a*. Moreover, as shown in FIGS. 3 to 6, the large tank section 44 of the storage tank 10 includes a rear large tank section 44*a* disposed behind the discharge trap pipe 2*b*, a front large tank section 44*b* extending forward from the rear large tank section 44*a* while being disposed on one of the left and right sides of the discharge trap pipe 2*b* (the right side when the toilet main body 2 is seen from the front), and a lower large tank section 44*c* extending downward from the rear large tank section 44*a*. Next, as shown in FIGS. 3 to 6, the small tank section 46 of the storage tank 10 includes a rear small tank section 46*a* disposed behind the discharge trap pipe 2*b*, and a front small tank section 46*b* extending forward from the rear small tank section 46*a* while being disposed on other one of the left and right sides of the discharge trap pipe 2*b* (the left side when the toilet main body 2 is seen from the front). That is, as shown in FIGS. 1, 3 and 4, the storage tank 10 is disposed in a manner surrounding an upper part of the discharge trap pipe 2*b* from both the left and right sides and from a rear side.

Next, as shown in FIG. 4, the toilet main body 2 includes, in a region behind the bowl 2*a*, a large-tank housing section S1 and a small-tank housing section S1 for housing the large tank section 44 and the small tank section 46, respectively, at a position higher than a floor surface. That is, in the region behind the bowl 2*a* of the toilet main body 2, the large-tank housing section S1 is formed on one of left and right sides of the vertical plane A1 that divides the region into two in the left-right direction (on the right side of the vertical plane A1 when the toilet main body 2 is seen from front). In the region behind the bowl 2*a* of the toilet main body 2, the small-tank housing section S2 is formed on the other one of the left and right sides of the vertical plane A1 (on the left side of the vertical plane A1 when the toilet main body 2 is seen from the front).

Furthermore, as shown in FIGS. 4 to 6, in a state where the large tank section 44 and the small tank section 46 are disposed in the large-tank housing section S1 and the small-tank housing section S2, respectively, a lowest position of a bottom surface of the large tank section 44 (a lowest position P1 of a bottom surface 44*d* of the lower large tank section 44*c*) is positioned lower than a lowest position of a bottom surface of the small tank section 46 (a lowest position P2 of a bottom surface 46*c* of the rear small tank section 46*a* and the front small tank section 46*b*). Furthermore, as shown in FIGS. 4 to 6, in the state where the large tank section 44 and the small tank section 46 are disposed in the large-tank housing section S1 and the small-tank housing section S2, respectively, a highest position of an upper surface 44*e*, of the large tank section 44, where a water supply port (an upper opening 10*a*) is formed (a highest position P3 of the upper surface 44*e* of the front large tank section 44*b*) is positioned higher than a highest position P4 of an upper surface 46*d* of the rear small tank section 46*a* and the front small tank section 46*b* of the small tank section 46 and lower than an upper surface 2*i* of the rim 2*c* of the toilet main body 2. Furthermore, as shown in FIGS. 3 to 6, a position P5 of a front end 44*f* of the front large tank section 44*b* is positioned more forward than a position P6 of a front end 46*e* of the front small tank section 46*b*.

As shown in FIGS. 2 and 4, the suction pipe 38 is provided along and inside both the rear large tank section 44*a* and the lower large tank section 44*c* of the large tank section 44 of the tank main body 40. Moreover, the upstream end 36*a* of the water passage pipe 36 extending (sideways) on an upstream side from the pump 30 is connected, in a watertight manner, to the downstream end 38*a* of the suction pipe 38, that is a part of the large tank section 44. Furthermore, as shown in FIG. 3, an upstream end of the water discharge pipe 8 is connected to a downstream end of the water passage pipe 36 extending on a downstream side (upward) from the pump 30, and a downstream end (an outlet 8*a*) of the water discharge pipe 8 is connected to the inlet 2*e* of the rim conduit 2*d* on the other one of the left and right sides of the vertical plane A1 of the toilet main body 2 (on the left side of the vertical plane A1 when the toilet main body 2 is seen from the front).

Next, as shown in FIG. 4, a side wall surface 44*g* of the large tank section 44, on the side of the vertical plane A1 (at the center in the left-right direction), is positioned inside the large-tank housing section S1 and outward of the discharge trap pipe 2*b* (on the right side when the discharge trap pipe 2*b* is seen from the front). Likewise, a side wall surface 46*f* of the small tank section 46, on the side of the vertical plane A1 (at the center in the left-right direction), is positioned inside the small-tank housing section S2 and outward of the discharge trap pipe 2*b* (on the left side when the discharge trap pipe 2*b* is seen from the front). Furthermore, as shown in FIGS. 4 and 5, the discharge trap pipe 2*b* is provided at the center of the toilet main body 2 in the left-right direction, and the upstream end 36*a* of the water passage pipe 36 is connected to the side wall surface 44*g* on the discharge trap pipe 2*b* side, of the left and right side surface of the large tank section 44.

Furthermore, as shown in FIGS. 3 and 4, the pump 30 is disposed behind the bowl 2*a* of the toilet main body 2, at a position higher than the discharge trap pipe 2*b*. Furthermore, the pump 30 is disposed more to the front than the rear large tank section 44*a* and the rear small tank section 46*a*, in a space between the front large tank section 44*b* and the front small tank section 46*b* in the left-right direction. The pump 30 is thus provided more to the center of the toilet main body 2 in the left-right direction than the upstream end 36*a* of the water passage pipe 36 and the downstream end (the outlet 8*a*) of the water discharge pipe 8.

Figure 7:
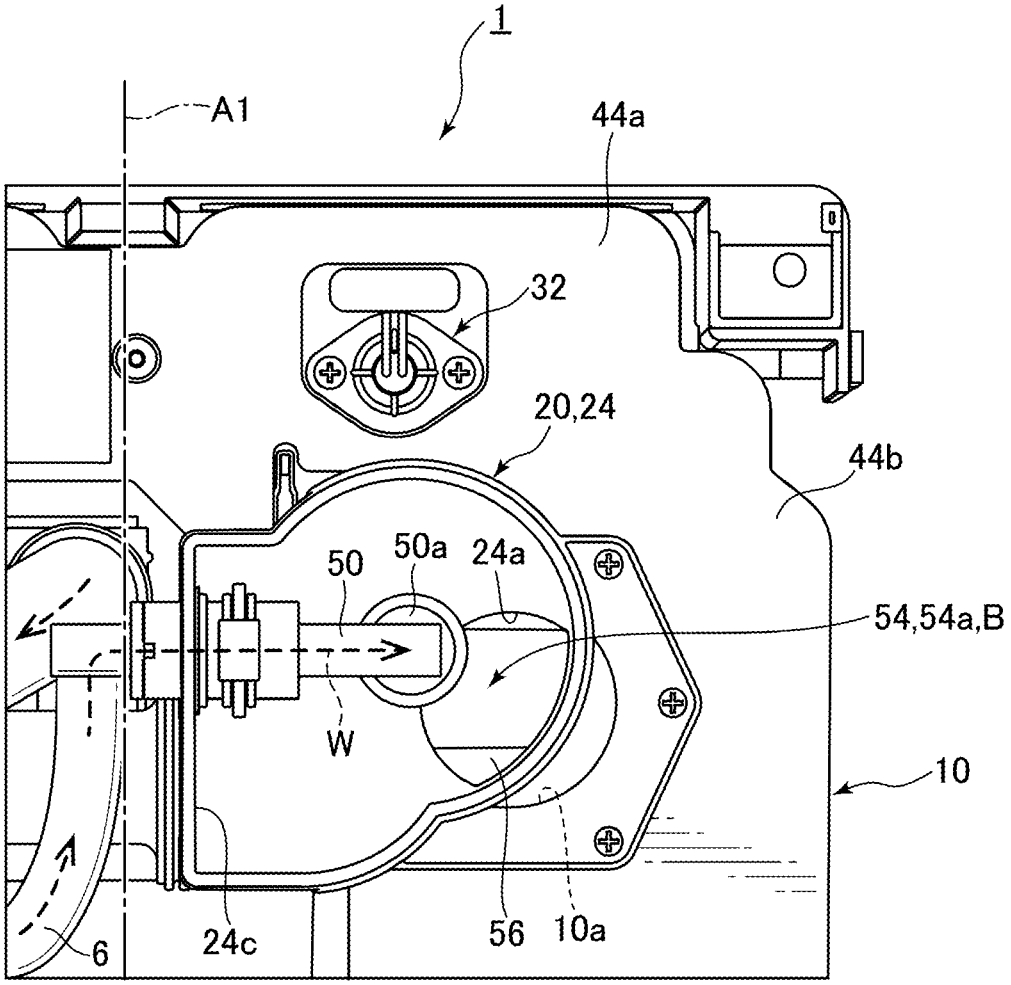
FIG. 7 is an enlarged partial plan view showing a part of the flush toilet according to the embodiment of the present invention shown in FIG. 3 in an enlarged manner, the part corresponding to a water receiving housing.
Figure 8:
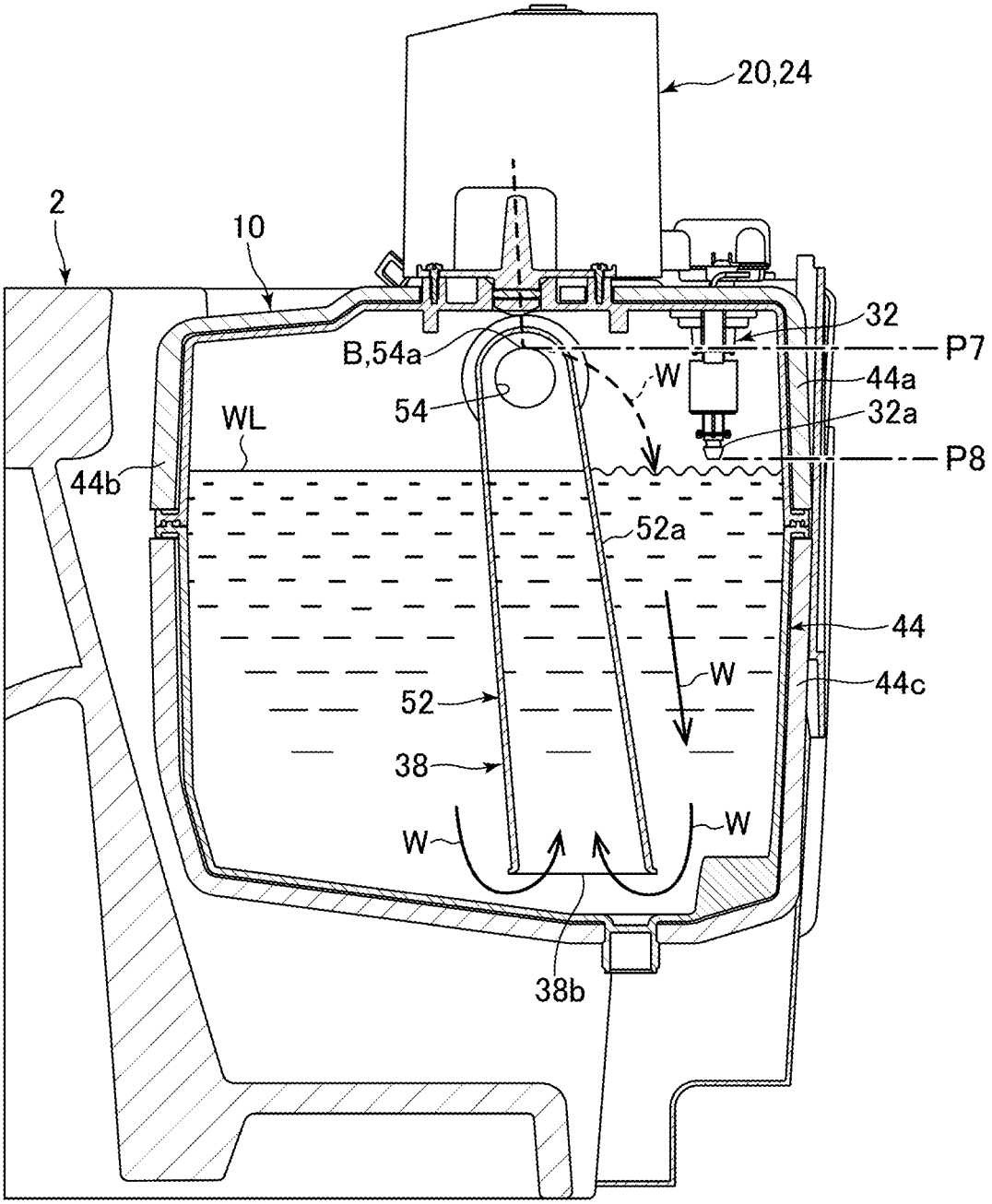
FIG. 8 is a cross-sectional view taken along a line VIII-VIII in FIG. 3.

Next, details of the flush toilet 1 according to the embodiment of the present invention will be given with reference to FIGS. 1 to 8, focusing on the water receiving housing 24 (the small tank) of the connecting unit 20, and the water passage pipe 36 and the suction pipe 38 outside and inside the storage tank 10. FIG. 7 is an enlarged partial plan view showing a part of the flush toilet according to the embodiment of the present invention shown in FIG. 3 in an enlarged manner, the part corresponding to the water receiving housing. Furthermore, FIG. 8 is a cross-sectional view taken along a line VIII-VIII in FIG. 3. Additionally, in relation to the water receiving housing 24 of the connecting unit 20, FIGS. 4 and 7 show a state where an upper lid 48 of the water receiving housing 24 shown in FIG. 3 is removed. First, as shown in FIGS. 4 and 7, the water supply pipe 6 is connected to the water receiving housing 24 of the connecting unit 20, at an upper part of a side wall 24*c* that is on the left side when the toilet main body 2 is seen from the front. A water supply nozzle 50 (a water supply unit) that extends into the water receiving housing 24 is provided on the downstream side of the water supply pipe 6. Furthermore, a water supply port 50*a* (the water supply unit) that faces downward is provided at a distal end of the water supply nozzle 50. Moreover, the overflow pipe 26 is connected, via the check valve 28, to the overflow port 24*b* at a lower part of the side wall 24*c* of the water receiving housing 24.

Next, as shown in FIGS. 4, 7 and 8, the suction pipe 38 in the storage tank 10 is entirely provided in the large tank section 44. Specifically, the suction pipe 38 includes a vertical pipe part 52 that extends in the up-down direction, and a transverse pipe part 54 that extends horizontally in the left-right direction from an upper end portion of the vertical pipe part 52. Furthermore, the water passage pipe 36 extends horizontally in the left-right direction (on the upstream side) from a drive unit D of the pump 30, and the upstream end 36*a* of the water passage pipe 36 is made an outer water passage pipe that is connected from outside to the side wall surface 44*g* of the large tank section 44 of the storage tank 10. Furthermore, the transverse pipe part 54 of the suction pipe 38 extends horizontally in the left-right direction, and the downstream end 38*a* of the transverse pipe part 54 forms a downstream-end opening that is provided on the pump 30 side. Furthermore, the downstream end 38*a* of the transverse pipe part 54 is made to an inner water passage pipe that is disposed in the large tank section 44 of the storage tank 10 while being connected to the upstream end 36*a* of the water passage pipe 36 (the outer water passage pipe). Furthermore, the vertical pipe part 52 of the suction pipe 38 extends downward from a connection portion (an upper end portion) that is connected to one end side (the right side in the left-right direction in FIG. 4) of the transverse pipe part 54, to an upstream opening (the suction port 38*b*) at a lower end. More specifically, the vertical pipe part 52 of the suction pipe 38 is formed such that, in a cross-sectional side view shown in FIG. 8, an outer circumferential surface 52*a* thereof extends from above to obliquely downward and rearward to the suction port 38*b*.

Furthermore, the downstream end 38*a* of the transverse pipe part 54 (the inner water passage pipe) of the suction pipe 38 is connected in a watertight manner to the upstream end 36*a* of the water passage pipe 36 (the outer water passage pipe), on the outside of the side wall surface 44*g* of the large tank section 44 of the storage tank 10. The transverse pipe part 54 is formed into a cylindrical shape, and thus, a collision area (a collision region surface B) formed on an upper surface 54*a* of the transverse pipe part 54 is formed into a curved surface.

Next, as shown in FIGS. 4, 7 and 8, the collision region surface B (the collision area) formed on the upper surface 54*a* of the transverse pipe part 54 (the inner water passage pipe) of the suction pipe 38 is positioned below a communicating hole 56 between the storage tank 10 (the storage tank main body) and the water receiving housing 24 (the small tank). A height position P7 of the collision region surface B is positioned higher than a lower end (a position P8) of a sensing unit 32*a* of the float switch 32. Moreover, as shown in FIGS. 7 and 8, the float switch 32 is a single float switch 32 that is disposed in the storage tank 10, on a side (rear side) that is perpendicular to an axial direction of the transverse pipe part 54 of the suction pipe 38.

Accordingly, as shown in FIGS. 4, 7 and 8, the water supply port (the upper opening 10*a*) is provided in the upper surface 44*e* of the large tank section 44 of the storage tank 10 (the storage tank main body), and the flush water W that is discharged from the water supply port 50*a* of the water supply nozzle 50 passes through the communicating hole 56 between the lower opening 24*a* of the water receiving housing 24 (the small tank) and the water supply port (the upper opening 10*a*) in the upper surface 44*e* of the large tank section 44 of the storage tank 10 (the storage tank main body). Moreover, as shown in FIGS. 4, 7 and 8, supplied water (the flush water W) flowing into the storage tank 10 through the communicating hole 56 falls onto the collision area (the collision region surface B) on the upper surface 54*a* of the transverse pipe part 54 of the suction pipe 38, and then, the flush water W at least partially falls onto a water surface WL on the float switch 32 side in the storage tank 10. The water surface WL near a lower end of the sensing unit 32*a* of the float switch 32 in the rear large tank section 44*a* of the storage tank 10 is thus caused to ripple. Then, water drops or mist-like water drops are finely dispersed and adhere to the sensing unit 32*a* of the float switch 32, so that the sensing unit 32*a* of the float switch 32 is kept in a moistened state and is enabled to operate at all times without becoming fixed. The sensing unit 32*a* of the float switch 32 is placed in an on state when the water surface WL in the storage tank 10 rises and contacts the lower end of the sensing unit 32*a*. By contrast, in the case where the water surface WL in the storage tank 10 is lower than a lower end position of the sensing unit 32*a* of the float switch 32, the sensing unit 32*a* of the float switch 32 is in an off state.

Furthermore, as shown in FIGS. 4, 7 and 8, the supplied water (the flush water W) flowing into the storage tank 10 through the communicating hole 56 falls onto the collision area (the collision region surface B) on the upper surface 54*a* of the transverse pipe part 54 of the suction pipe 38, and then, onto the water surface WL behind the vertical pipe part 52 of the suction pipe 38 in the storage tank 10. Then, at least a part of the flush water W falling onto the water surface WL is able to flow toward the suction port 38*b* of the suction pipe 38.

Next, effects of the flush toilet 1 according to the embodiment of the present invention described above will be described with reference to FIGS. 1 to 8. First, with the flush toilet 1 according to the embodiment of the present invention, due to the drive unit D of the pump 30 being driven while flush water that is discharged from the water supply unit (the water supply port 50*a* of the water supply nozzle 50) is being supplied to the storage tank 10 through the water supply port (the upper opening 10*a*) of the storage tank main body (the storage tank 10), the flush water may be fed, under pressure, from the storage tank 10 to the toilet main body 2. At this time, because so-called "follow-up water supply" of performing water supply to the storage tank 10 and supply of flush water from the pump 30 to the toilet main body 2 at the same time can performed, the amount of stored water in the storage tank 10 may be reduced, and the size of the storage tank 10 may be reduced. Furthermore, the water supply port (the upper opening 10*a*) of the storage tank 10 and the upstream-end opening (the suction port 38*b*) of the suction pipe 38 are both provided on the large tank section 44 side where a lowest bottom surface (the bottom surface 44*d* of the lower large tank section 44*c*) of the storage tank 10 is included. Accordingly, when the flush water that is discharged from the water supply unit (the water supply port 50*a* of the water supply nozzle 50) is supplied to the storage tank 10 through the water supply port (the upper opening 10*a*) of the storage tank main body (the storage tank 10), the flush water may be supplied first to the large tank section 44 side with a larger capacity than the small tank section 46. Accordingly, supply of water to the suction pipe 38 provided on the large tank section 44 side of the storage tank 10 does not run out, and even in a case where the follow-up water supply is performed for the storage tank 10 having a complex tank shape due to the small tank section 46 and the large tank section 44, toilet flushing may be prevented from being interrupted. As a result, the size of the storage tank 10 can be reduced, and also, a sufficient amount of flush water can be supplied from the tank device 4 to the toilet main body 2.

Next, with the flush toilet 1 according to the present embodiment, the water supply port (the upper opening 10*a*) of the storage tank 10 is provided in the upper surface of the large tank section 44 (the upper surface 44*e* of the front large tank section 44*b*) of the storage tank 10, and also, the suction pipe 38 is provided in the large tank section 44 of the storage tank 10. Accordingly, both the water supply port (the upper opening 10*a*) of the storage tank 10 and the suction pipe 38 may be collectively provided at the large tank section 44 of the storage tank 10. Accordingly, a limited space behind the toilet main body 2 may be effectively used, and tank capacity of the storage tank 10 may be increased. Furthermore, by providing the water supply port (the upper opening 10*a*) of the storage tank 10 and the suction pipe 38 on the large tank section 44 side of the storage tank 10, flush water may be supplied first to the large tank section 44 with a larger capacity than the small tank section 46, and thus, supply of water to the suction pipe 38 may be prevented from running out. Accordingly, the follow-up water supply may be continuously performed.

Moreover, with the flush toilet 1 according to the present embodiment, the collision area (the collision region surface B) provided in the storage tank 10 may cause at least a part of the flush water W colliding into the collision area (the collision region surface B) to flow toward the upstream-end opening (the suction port 38*b*) of the suction pipe 38, and thus, the flush water may be efficiently guided toward the suction pipe 38. Accordingly, even when positions of the water supply port (the upper opening 10*a*) and the suction pipe 38 at the storage tank 10 are shifted from each other, flush water that is supplied to the storage tank 10 from the water supply port (the upper opening 10*a*) of the storage tank 10 may be supplied preferentially to the upstream-end opening (the suction port 38*b*) of the suction pipe 38. Accordingly, supply of water to the suction pipe 38 is prevented from running out, and the follow-up water supply may be continuously performed.

Furthermore, with the flush toilet 1 according to the present embodiment, even when positions of the water supply port (the upper opening 10*a*) and the suction pipe 38 (the vertical pipe part 52 and the transverse pipe part 54) at the storage tank 10 are shifted from each other, the flush water W that is supplied to the storage tank 10 from the water supply port (the upper opening 10*a*) of the storage tank 10 may be made to collide into the collision area (the collision region surface B) provided below the water supply port (the upper opening 10*a*), on a circumferential surface (the upper surface 54*a*) of the transverse pipe part 54 of the suction pipe 38 in the storage tank 10. Then, at least a part of the flush water W colliding into the collision area (the collision region surface B) can easily flow to the upstream-end opening (the suction port 38*b*) of the vertical pipe part 52 of the suction pipe 38 thanks to the outer circumferential surface 52*a*, of the vertical pipe part 52 of the suction pipe 38, extending obliquely downward toward the opening (the suction port 38*b*) at the upstream end (the lower end), and thus, the flush water supplied to the storage tank 10 may be efficiently and preferentially guided to the suction pipe 38 side. Accordingly, supply of water to the suction pipe 38 is prevented from running out, and the follow-up water supply may be continuously performed. Furthermore, because the outer circumferential surface 52*a* of the vertical pipe part 52 of the suction pipe 38 is formed to extend obliquely downward, in the side view in FIG. 8, toward the upstream-end opening (the suction port 38*b*) from the connection portion to the transverse pipe part 54 (that is, the upper end portion of the vertical pipe part 52), a height dimension of the vertical pipe part 52 of the suction pipe 38 in the up-down direction may be kept small. Accordingly, a housing space for the storage tank 10 in the up-down direction may be made small on the large tank section 44 side where the suction pipe 38 is provided.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet for discharging waste with flush water, the flush toilet comprising:

a toilet main body including a bowl configured to receive waste, a rim formed at a top edge of the bowl, and a discharge trap configured to discharge the waste in the bowl; and a tank device configured to supply the flush water to the toilet main body, the tank device being provided behind the toilet main body, wherein the tank device includes a storage tank main body provided behind the toilet main body and above a floor surface, a water supply unit configured to supply the flush water supplied from a water supply source to the storage tank main body, a pump provided on a downstream side of the storage tank main body, the pump being configured to feed the flush water from the storage tank main body to the toilet main body under pressure, and a suction pipe including an upstream-end opening provided in the storage tank main body, the suction pipe being configured to allow suction of the flush water in the storage tank main body from the upstream-end opening to a pump side by operation of a drive unit of the pump, wherein the water supply unit is configured to supply water to the storage tank main body while the pump is being driven, the storage tank main body includes a large tank section on a large-capacity side and a small tank section on a small-capacity side, the large tank section including a lowest bottom surface of the storage tank main body, and the storage tank main body includes a water supply port on an upper surface of the storage tank main body, the water supply unit being configured to supply the flush water to the storage tank main body through the water supply port, and the water supply port of the storage tank main body and the upstream-end opening of the suction pipe are both provided on a large tank section side.

2. The flush toilet according to claim 1, wherein the storage tank main body has a shape that is asymmetrical in a left-right direction due to the large tank section and the small tank section, the large tank section being provided on a large-capacity side of the storage tank main body that is divided into two at a center in the left-right direction, the small tank section being provided on a small-capacity side of the storage tank main body that is divided into two at the center in the left-right direction, and the water supply port of the storage tank main body is provided in an upper surface of the large tank section, and the suction pipe is provided in the large tank section.

3. The flush toilet according to claim 1, wherein the storage tank main body includes a collision area where the flush water supplied from the water supply unit into the storage tank main body collides, and the collision area is configured to allow at least a part of the flush water to flow toward the upstream-end opening of the suction pipe after collision.

4. The flush toilet according to claim 3, wherein the suction pipe further includes a downstream-end opening that is provided on the pump side, a transverse pipe part that horizontally extends in a left-right direction from the downstream-end opening, and a vertical pipe part that extends from one end side of the transverse pipe part to the upstream-end opening, where the collision area is provided on a circumferential surface, of the transverse pipe part, disposed below the water supply port, and an outer circumferential surface of the vertical pipe part is formed to extend obliquely downward, in a side view, toward the upstream-end opening from a connection portion to the transverse pipe part.

* * * * *